United States Patent [19]

Yokoyama et al.

[11] Patent Number: 4,934,923

[45] Date of Patent: Jun. 19, 1990

[54] PULSE COMBUSTION APPARATUS

[75] Inventors: Nobuyoshi Yokoyama, Toyoake; Tsuneyasu Hayakawa, Kani, both of Japan

[73] Assignee: Paloma Kogyo Kabushiki Kaisha, Nagoya, Japan

[21] Appl. No.: 246,989

[22] Filed: Sep. 20, 1988

[30] Foreign Application Priority Data

Apr. 27, 1988 [JP] Japan ..... 63-104965

[51] Int. Cl.[5] ..... F23C 11/04

[52] U.S. Cl. ..... 431/1; 60/39.76

[58] Field of Search ..... 431/1, 158; 60/39.76, 60/39.77, 39.78, 39.8; 122/24

[56] References Cited

U.S. PATENT DOCUMENTS 2,898,978 . 8/1959 Kitchen et al. ..... 60/39.77 X 4,715,807 12/1987 Yokoyama et al. ..... 431/1

*Primary Examiner*—Randall L. Green

*Attorney, Agent, or Firm*—Lahive & Cockfield

[57] ABSTRACT

A gas distributor in the fuel gas supply system of a pulse combustion apparatus comprises a cylindrical wall having one end connected to the rest of the fuel gas supply system and another end defining an end wall facing a flame trap and spaced apart therefrom. The distributor is removably connected to the rest of the fuel gas supply system and its end wall has an adjustable distance from the flame trap. The distributor has a plurality of nozzle openings which may be provided through its cylindrical or end wall, or through both of its cylindrical and end walls.

8 Claims, 5 Drawing Sheets

PULSE COMBUSTION APPARATUS

BACKGROUND OF THE INVENTION

1. Field of the Invention

This invention relates to a pulse combustion apparatus which can be used effectively as a source of heat for, for example, a hot water supply system of the type in which heated water can be stored.

2. Description of the Prior Art

There is known a pulse combustion apparatus having a combustion chamber in which a mixture of fuel gas and air repeats explosion and combustion in a pulsating way. A typical example of the known apparatus is shown in FIG. 8. It includes a gas distributor 4' projecting into a mixing chamber 3' which is connected to a combustion chamber not shown through a flame trap 2'. The gas distributor 4' is defined at one end of a gas valve housing 11' extending from a gas chamber 10' and has a plurality of nozzle openings 5'. A gas flapper valve $V_1'$ is provided in the gas valve housing 11' toward its end which is remote from the gas distributor 4'. An air flapper valve $V_2'$ has an air plate 17' on which the gas valve housing 11' is supported adjacent to the gas distributor 4'.

In the known apparatus shown in FIG. 8, however, the gas distributor 4' forms an integral part of the gas valve housing 11' and the nozzle openings 5' are provided only through the circumferential wall of the gas distributor 4'. Therefore, the position of the gas distributor 4' in the mixing chamber 3' is fixed and unadjustable, and the directions in which the nozzle openings 5' are directed are also fixed and unadjustable. This disables the apparatus to be equally useful for burning various kinds of gas having different rates of combustion. The gas which is supplied through the gas distributor 4' is completely mixed with air in the mixing chamber 3'. This presents a problem particularly when the gas which is employed is one which is highly ignitable and burns rapidly, such as town gas having a high hydrogen content (e.g. gas known as 6C or 5C). If a mixture of such gas and air is supplied into the combustion chamber through the flame trap 2', a flame is likely to enter the flame trap 2' and cause a backfire resulting in the occurrence of combustion only in a limited area, or diffused combustion is likely to occur near the outlet of the flame trap 2'. There is, therefore, every likelihood that no stable combustion may be obtained continuously.

SUMMARY OF THE INVENTION

Under these circumstances, it is an object of this invention to provide a pulse combustion apparatus which is useful for burning various kinds of fuel gas having different rates of combustion.

This object is essentially attained by employing a plurality of gas distributor designs which are so selected as to suit different kinds of fuel gas.

According to one aspect of this invention, the apparatus includes a gas distributor having a plurality of nozzle openings which are directed perpendicularly to the longitudinal axis of the gas distributor. This gas distributor is useful when it is desirable to form a complete mixture of fuel gas and air and supply it into the combustion chamber, and therefore when the apparatus is intended for burning gas having a relatively low rate of combustion, such as propane or butane gas.

According to another aspect of this invention, the gas distributor has a plurality of nozzle openings which are parallel to its longitudinal axis, and a plurality of nozzle openings which are perpendicular to its longitudinal axis. This gas distributor is useful when it is desirable to form a partial mixture of fuel gas and air and supplying it into the combustion chamber, and therefore when the apparatus is intended for burning gas having a relatively high rate of combustion, such as natural gas.

According to still another aspect of this invention, the gas distributor has a plurality of nozzle openings which are all parallel to its longitudinal axis, and includes a cylindrical extension reaching a flame trap. The nozzle openings are all open within the extension. This gas distributor is useful when it is desirable to supply fuel gas and air separately into the combustion chamber without mixing them, and therefore when the apparatus is intended for burning gas having a very high rate of combustion, such as gas having a high hydrogen content.

Other features and advantages of this invention will be apparent from the following description and the accompanying drawings.

DETAILED DESCRIPTION OF THE INVENTION

Figure 1:
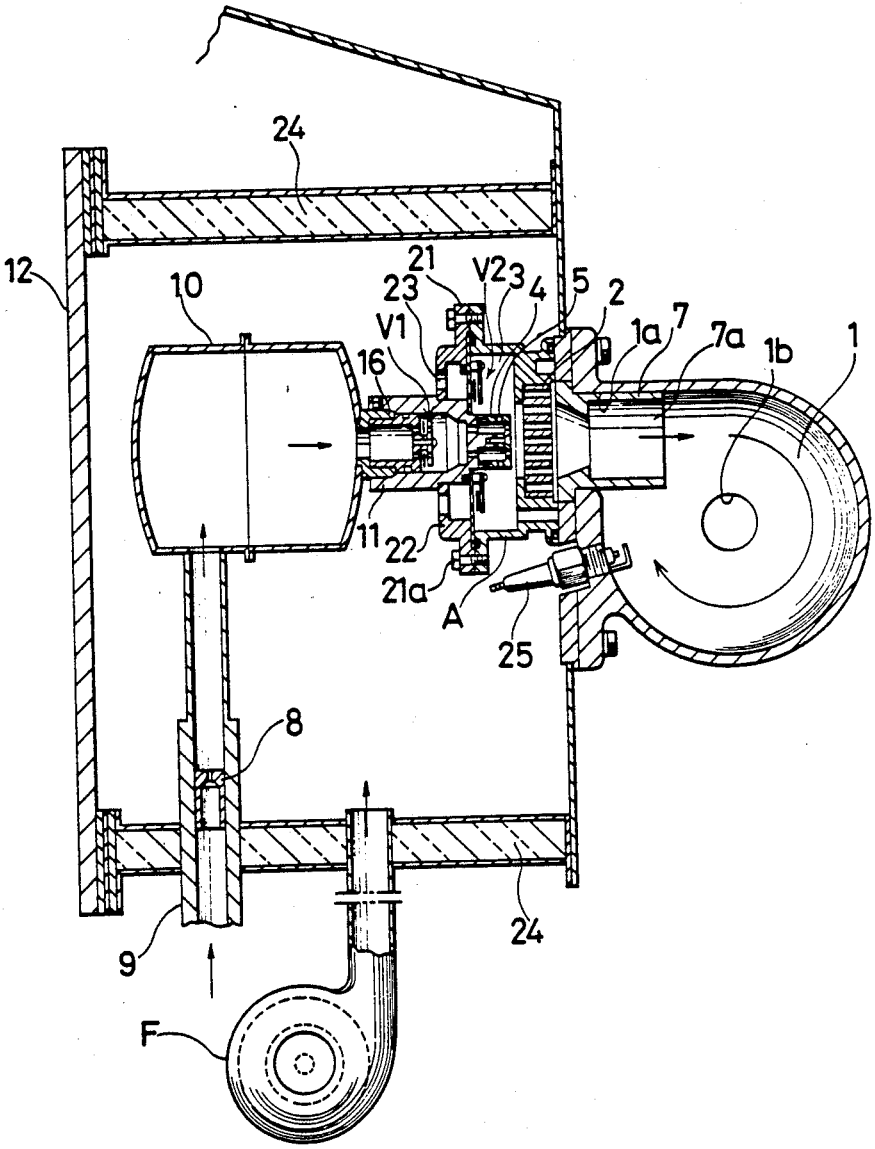
FIG. 1 is a longitudinal cross-sectional view of a pulse combustion apparatus embodying this invention.

A pulse combustion apparatus embodying this invention is generally shown in FIG. 1. It includes a combustion chamber 1 having a substantially circular cross section. The combustion chamber 1 has an inlet 1*a* for a mixture of fuel and air through which it can be introduced tangentially into the combustion chamber 1, and an outlet 1*b* through which exhaust gas can be discharged from the combustion chamber 1 in a direction perpendicular to the mixture of fuel and air which is introduced thereinto. The inlet 1*a* is defined by a head (nozzle pipe) 7 which is provided for promoting the flow of a mixture of fuel and air into the combustion chamber 1. The head 7 is relatively long and has an outlet 7*a* located relatively close to the center of the combustion chamber 1, so that no flame may enter the head 7*a* and prevent a mixture of fuel and air from flowing smoothly into the combustion chamber 1.

A flame trap 2 is provided on the opposite side of the inlet 1*a* from the combustion chamber 1. It is formed from a porous plate of a heat resistant material and is secured to a housing A defining a mixing chamber 3. The mixing chamber 3 is defined on the opposite side of the flame trap 2 from the combustion chamber 1 and is fluidally connected to the combustion chamber 1 through the flame trap 2.

A fuel gas supply system and an air supply system are connected to the mixing chamber 3. The fuel gas supply system comprises a gas admitting pipe 9 having a main nozzle 8, a gas chamber 10, a gas flapper valve $V_1$, a gas valve housing 11 and a gas distributor 4. The air supply system comprises an air blower F, an air chamber 12 and an air flapper valve $V_2$. The gas flapper valve $V_1$ has a flapper valve member 15 disposed between two parallel valve seats 13 and 14 having a small distance therebetween. The valve member 15 is movable between the valve seats 14 and 13 by any difference of gas pressure that may prevail between the upstream and downstream sides of the valve as combustion proceeds, so that the valve $V_1$ may allow the supply of fuel gas into the mixing chamber 3 and its interruption alternately during each cycle of combustion. The valve $V_1$ is supported on one end of a nozzle cylinder 16*a* projecting from a short cylinder 16 connected to the gas chamber 10. The nozzle cylinder 16*a* has an end wall provided therethrough with a plurality of nozzle openings and defining the valve seat 13. The cylinders 16 and 16*a* are surrounded by the gas valve housing 11 toward its end close to the gas chamber 10. The gas chamber 10 is provided for equalizing the pressure of fuel gas which is admitted thereinto.

The air flapper valve $V_2$ has a flapper valve member 19 disposed between an air plate 17 and a back plate 18 lying in parallel to each other and having a small distance therebetween. The valve member 19 is movable between the plates 18 and 17 by the difference of fluid pressure which may prevail between the upstream and downstream sides of the valve as combustion proceeds, so that the valve $V_2$ may allow the supply of air into the mixing chamber 3 and its interruption alternately during each cycle of combustion. The valve $V_2$ is situated on the opposite side of the mixing chamber 3 from the flame trap 2.

Referring now to a salient feature of this invention, the gas distributor 4 is removably attached to the end of the gas valve housing 11 in the mixing chamber 3 by a screw 20. The gas distributor 4 has a plurality of nozzle openings 5 which may be arranged in a number of different patterns, as will later be described in detail. The removable gas distributor 4 can be changed to another gas distributor having a different arrangement of nozzle openings. The gas distributor to be used depends on the type of fuel gas which is burned. The apparatus of this invention can, therefore, be used for burning any of various kinds of fuel gas having different rates of combustion. The term "rate of combustion" as herein used means the combustibility of fuel gas which depends on its hydrogen content, and which is usually expressed as its CP value. The CP values of various kinds of fuel gas which are currently in common use range from 20 to 110.

The gas valve housing 11 is firmly held in position by a plurality of supporting arms 22 each having a radially outer end 21 secured to the mixing chamber housing A by a bolt 21*a*. Each arm 22 has a through hole 23. The gas admitting pipe 9, gas chamber 10, gas valve housing 11, arms 22 and housing A are all located in the air chamber 12. The air chamber 12 is provided for equalizing the pressure of air which is admitted thereinto, before it is supplied through the air flapper valve $V_2$. The air chamber 12 has a top and a bottom wall which are each filled with a layer of sand 24 which contributes to reducing any vibration of the apparatus when it is in operation. A spark plug 25 is provided for igniting a mixture of fuel and air in the combustion chamber 1.

Description will now be made of a number of different forms of gas distributor which are shown by way of example in FIGS. 2 to 7. Each of the apparatus shown in FIGS. 2 to 7 has a large number of components in common with the apparatus which has already been described with reference to FIG. 1. No description of any such common component will hereinafter be repeated.

Figure 2:
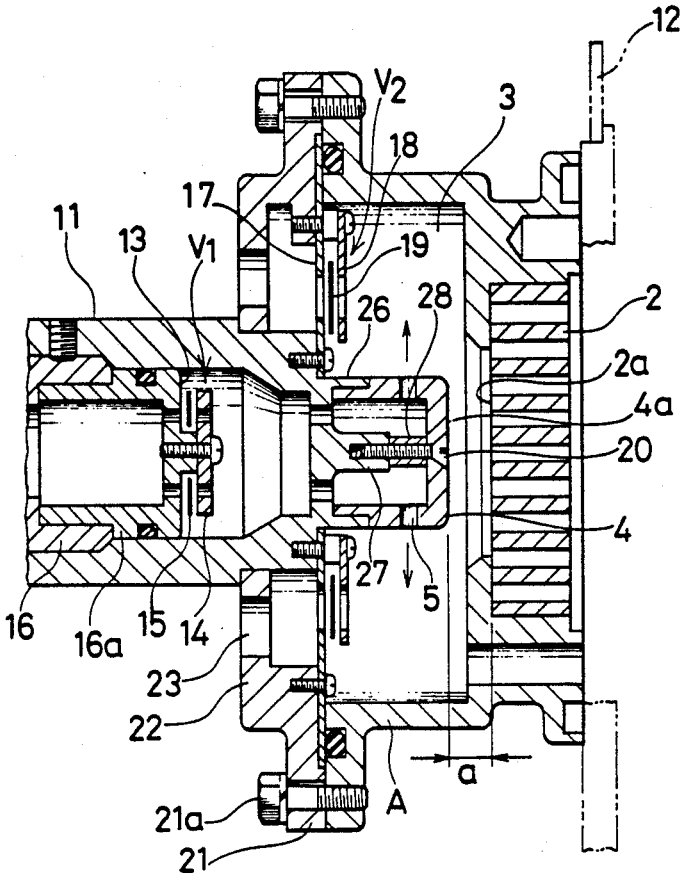
FIG. 2 is a fragmentary longitudinal crosssectional view of the apparatus according to one aspect of this invention.
Figure 3:
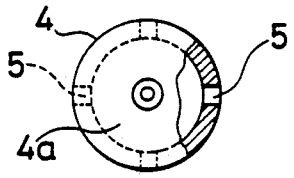
FIG. 3 is a front view, partly in section, of the gas distributor in the apparatus shown in FIG. 2.

Referring first to FIGS. 2 and 3, the gas distributor 4 has an end wall 4*a* facing the flame trap 2 and a cylindrical sidewall extending between its end wall 4*a* and the gas valve housing 11. The end wall 4*a* has a certain distance a from the flame trap 2. The cylindrical sidewall of the gas distributor 4 is provided therethrough near its end wall 4*a* with a plurality of circumferentially equally spaced apart nozzle openings 5. The nozzle openings 5 are, therefore, perpendicular to the longitudinal axis of the gas distributor 4. The apparatus as shown in FIGS. 2 and 3 is useful for burning fuel gas having a relatively low rate of combustion, or a CP value of about 45, such as propane or butane gas.

Figure 4:
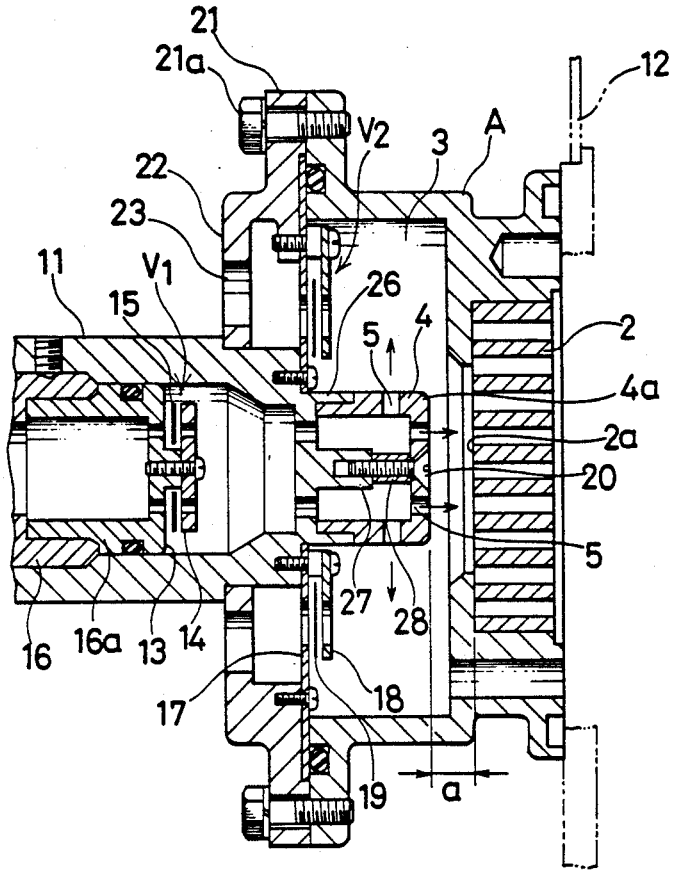
FIG. 4 is a view similar to FIG. 2, but showing the apparatus according to another aspect of this invention.
Figure 5:
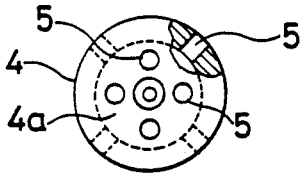
FIG. 5 is a front view, partly in section, of the gas distributor in the apparatus shown in FIG. 4.

Referring now to FIGS. 4 and 5, another form of gas distributor 4 has an end wall 4*a* facing the flame trap 2 and a cylindrical sidewall extending between its end wall 4*a* and the gas valve housing 11, and the end wall 4*a* has a certain distance a from the flame trap 2, as is the case with the gas distributor shown in FIG. 2. The gas distributor 4 shown in FIGS. 4 and 5 is, however, provided with a plurality of nozzle openings 5 through each of its sidewall and end wall 4*a*. The nozzle openings 5 of the end wall 4*a* are parallel to the longitudinal axis of the gas distributor 4 and form a circular array in which they are equally spaced apart from one another, as shown in FIG. 5, while the nozzle openings 5 of the cylindrical sidewall are perpendicular to the longitudinal axis of the gas distributor 4 and are circumferentially spaced apart from one another. The gas leaving the nozzle openings 5 of the sidewall is mixed with air in the mixing chamber 3, but the gas leaving the nozzle openings 5 of the end wall 4*a* is supplied into the combustion chamber 1 substantially directly. The apparatus as shown in FIG. 4 is, therefore, useful for burning fuel gas having a relatively high rate of combustion, or a CP value of about 53, such as natural gas.

Figure 6:
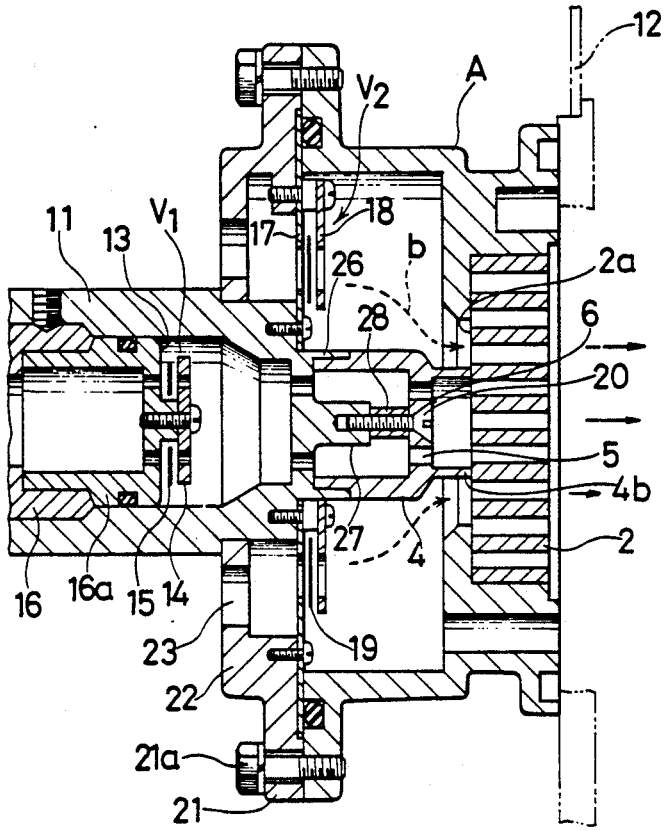
FIG. 6 is a view similar to FIG. 2, but showing the apparatus according to still another aspect of this invention.
Figure 7:
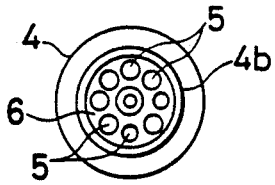
FIG. 7 is a front view of the gas distributor in the apparatus shown in FIG. 6.
Figure 8:
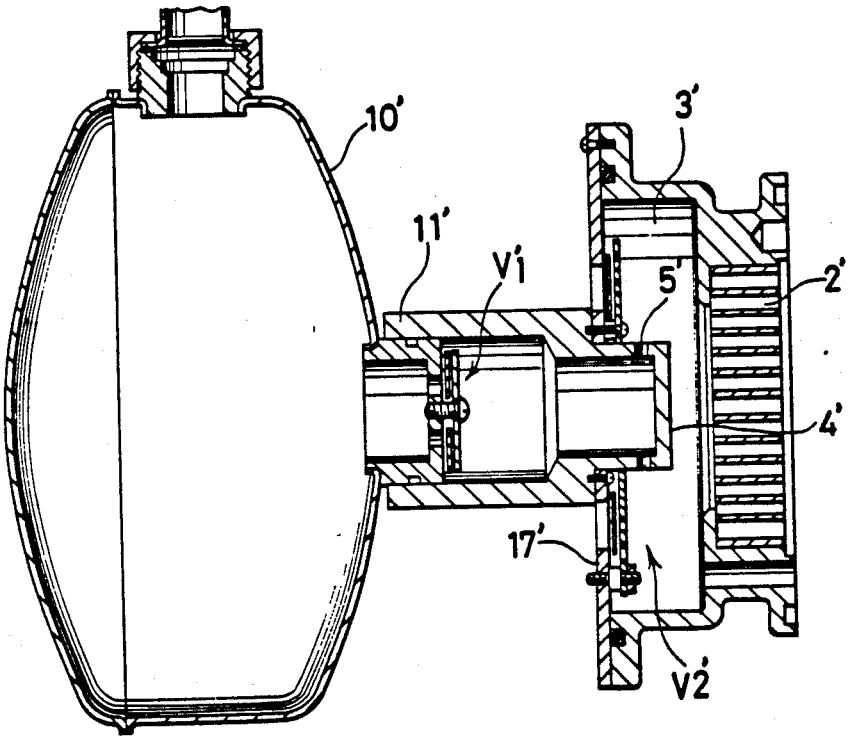
FIG. 8 ( PRIOR ART )
FIG. 8 is a fragmentary longitudinal crosssectional view of the known apparatus.

Attention is now directed to FIGS. 6 and 7 showing still another form of gas distributor. The gas distributor 4 has an end wall 6 facing the flame trap 2 and having a certain distance therefrom, and a cylindrical sidewall extending between its end wall 6 and the gas valve housing 11. The end wall 6 is provided therethrough with a circular array of equally spaced apart nozzle openings 5 which are parallel to the longitudinal axis of the gas distributor 4. The gas distributor 4 further includes a cylindrical extension 4*b* projecting from its end wall 6 coaxially therewith and contacting that surface 2*a* of the flame trap 2 which faces the end wall 6. The extension 4*b* has a wall thickness and a diameter which are smaller than those of the sidewall. The circular array of the nozzle openings 5 has an outside diameter which is slightly smaller than the inside diameter of the extension 4*b*, as shown in FIG. 7. Therefore, the fuel leaving the nozzle openings 5 is not allowed to enter the mixing chamber 3, but is supplied into the combustion chamber 1 directly through the extension 4*b* and separately from air. It is only in the combustion chamber 1 that fuel and air are mixed. Because of its small wall thickness and diameter, the extension 4b forms in the combustion chamber 1 only a relatively small zone where fuel and air are mixed, and also ensures a smooth flow of air from the mixing chamber 3 to the combustion chamber 1, as shown by arrow lines b in FIG. 6. The apparatus as shown in FIG. 6 is suitable for burning fuel gas having a very high rate of combustion, or a CP value of about 80, such as fuel having a high hydrogen content.

In any of the apparatus shown in FIGS. 2 to 7, the gas valve housing 11 has a short cylindrical projection 26 which is situated in the mixing chamber 3, and in which the end of the cylindrical sidewall of the gas distributor 4 is fitted coaxially therewith. The housing 11 also has a central boss 27 projecting into the gas distributor 4 coaxially therewith. The boss 27 has a threaded axial hole in which the screw 20 is engaged for connecting the gas distributor 4 to the housing 11. Therefore, the gas distributor 4 is easily removable from the housing 11 if the screw 20 is loosened and disengaged from the boss 27.

A tubular spacer 28 surrounding the screw 20 is provided between the end wall 4a or 6 of the gas distributor 4 and the boss 27 in any of the apparatus shown in FIGS. 2, 4 and 6. The spacer 28 is removable, and if another spacer having a different length is employed, it is possible to make even a very fine adjustment of the position which the gas distributor 4 occupies in the mixing chamber 3, or the distance between the gas distributor 4 and the flame trap 2.

The apparatus of this invention can, therefore, be used effectively for burning any of various kinds of fuel gas having different rates of combustion if an appropriate form of gas distributor having an appropriate arrangement of nozzle openings is selected and is appropriately positioned, as hereinabove described. The apparatus can maintain stable pulsating combustion without causing any backfire or diffused combustion.

Referring by way of example to the operation of the apparatus shown in FIGS. 1 and 2, fuel gas is supplied into the mixing chamber 3 through the gas admitting pipe 9, the main nozzle 8, the gas chamber 10, the gas flapper valve $V_1$, the gas valve housing 11, the gas distributor 4 and its nozzle openings 5, while air is also supplied thereinto through the blower F, the air chamber 12 and the air flapper valve $V_2$, and the fuel gas and the air are mixed in the mixing chamber 3. During the initial period of combustion, the fuel-air mixture is forced into the combustion chamber 1 and ignited by the spark plug 25. After the passage of a certain length of time, the blower F is stopped and the spark plug 25 is turned off. The apparatus is now self-aspirating as a negative pressure is created in the combustion chamber 1, and the fuel-air mixture is self-igniting under the heat which is stored in the combustion chamber 1. The apparatus continues pulsating combustion by repeating, say, 80 to 100 cycles of ignition, expansion and exhaust per second, while exhaust gas is directed to a tailpipe not shown through the outlet 1b of the combustion chamber 1. The apparatus ensures the maintenance of combustion under a high load and with a high thermal efficiency. Each of the apparatus shown in FIGS. 4 and 6 is also operable substantially in the same way, except that in the apparatus shown in FIG. 4, fuel and air are mixed only partly in the mixing chamber, and that in the apparatus shown in FIG. 6, fuel and air are mixed only in the combustion chamber.

While the invention has been described with reference to some preferred forms thereof, it is to be understood that modifications or variations may be easily made by anybody of ordinary skill in the art without departing from the spirit of this invention or the scope thereof which is defined by the appended claims.

What is claimed is:

1. A pulse combustion apparatus having (i) a combustion chamber, (ii) a mixing chamber in which gas and air can be mixed, (iii) a flame trap disposed between the combustion and mixing chambers, (iv) an air supply system connected to the mixing chamber, (v) a fuel gas supply system connected to the mixing chamber and including a cylindrical gas distributor which is located in the mixing chamber coaxially therewith and has an end wall facing the flame trap and spaced apart therefrom, (vi) connecting means for removably connecting the gas distributor to a body of the fuel gas supply system, and (vii) means for selectively changing the distance from the end wall of the gas distributor to the flame trap to be one of plural selected fixed distances to adapt the apparatus to differing rates of fuel combustion.

2. An apparatus of claim 1, further comprising a plurality of circumferentially equally spaced apart nozzle openings provided through a cylindrical wall of the gas distributor.

3. An apparatus of claim 2, further comprising a circular array of equally spaced apart nozzle openings provided though the end wall of the gas distributor.

4. An apparatus of claim 1, further including (a) a cylindrical extension projecting from the end wall of the gas distributor, contacting the flame trap, and having a smaller wall thickness and a smaller diameter than a cylindrical wall of the gas distributor, said cylindrical extension being coaxial with the cylindrical wall of the gas distributor, and (b) a circular array of equally spaced apart nozzle openings provided through the end wall of the gas distributor, said circular array having an outside diameter smaller than the inside diameter of the cylindrical extension.

5. An apparatus as set forth in any of claim 1 to 4, wherein said connecting means comprises a screw means which extends through the end wall of the gas distributor and is screwed into a boss of the gas distributor, and said adjusting means comprises a spacer disposed between the end wall of the gas distributor and the boss thereof to position the end wall with a desired distance from the flame trap.

6. An apparatus as set forth in any of claims 1 to 4, wherein said connecting means comprises a screw means which extends through the end wall of the gas distributor and is screwed into a boss of the gas distributor, and said adjusting means comprises a tubular spacer surrounding said screw means between the end wall of the gas distributor and the boss thereof to position the end wall with a desired distance from the flame trap.

7. An apparatus as set forth in claim 5, wherein said spacer is removable for replacement by another one having a different length to adjust the distance of the end wall of the gas distributor from the flame trap.

8. An apparatus as set forth in claim 6, wherein said spacer is removable for replacement by another one having a different length to adjust the distance of the end wall of the gas distributor from the flame trap.

* * * * *

UNITED STATES PATENT AND TRADEMARK OFFICE

CERTIFICATE OF CORRECTION

PATENT NO. : 4,934,923

DATED : June 19, 1990

INVENTOR(S) : Nobuyoshi Yokoyama et al.

It is certified that error appears in the above-identified patent and that said Letters Patent is hereby corrected as shown below:

Column 2, lines 28 and 42, replace "crosssectional" with -- cross-sectional --.

Column 4, lines 17 and 30, replace "distance a" with -- distance a --.

Column 5, line 7, replace "lines b" with -- lines b --.

Signed and Sealed this

Seventh Day of July, 1992

*Attest:*

DOUGLAS B. COMER

*Attesting Officer*

*Acting Commissioner of Patents and Trademarks*